US011715452B2

(12) United States Patent
Deng et al.

(10) Patent No.: US 11,715,452 B2
(45) Date of Patent: Aug. 1, 2023

(54) ACTIVE NOISE REDUCTION EARPHONE

(71) Applicant: NEWLINE CO., LTD., Beijing (CN)

(72) Inventors: Junxin Deng, Beijing (CN); Hui Zhou, Beijing (CN)

(73) Assignee: NEWLINE CO., LTD., Beijing (CN)

( * ) Notice: Subject to any disclaimer, the term of this patent is extended or adjusted under 35 U.S.C. 154(b) by 0 days.

(21) Appl. No.: 17/577,433

(22) Filed: Jan. 18, 2022

(65) Prior Publication Data

US 2023/0136280 A1 May 4, 2023

(30) Foreign Application Priority Data

Oct. 29, 2021 (CN) ..... 202122638225.8

(51) Int. Cl.

*G10K 11/178* (2006.01)
*H04R 1/10* (2006.01)
*H04R 1/02* (2006.01)

(52) U.S. Cl.

CPC ..... *G10K 11/17881* (2018.01); *H04R 1/023* (2013.01); *H04R 1/1016* (2013.01); *H04R 1/1075* (2013.01); *G10K 2210/1081* (2013.01); *G10K 2210/3026* (2013.01); *G10K 2210/3027* (2013.01); *G10K 2210/3045* (2013.01)

(58) Field of Classification Search

None

See application file for complete search history.

(56) References Cited

U.S. PATENT DOCUMENTS

2009/0080670 A1* 3/2009 Solbeck ..... H04R 25/453 381/71.6
2014/0226832 A1* 8/2014 Shimizu ..... H04R 1/1083 381/74
2014/0294182 A1* 10/2014 Axelsson ..... H04R 29/001 381/56
2020/0084535 A1* 3/2020 Perkmann ..... H04R 1/02
2021/0166674 A1* 6/2021 McCutcheon ..... H04R 1/1016

FOREIGN PATENT DOCUMENTS

CN 206380053 U 8/2017
CN 207382508 U 5/2018
CN 207543304 U 6/2018
CN 212413401 U 1/2021

* cited by examiner

*Primary Examiner* — Kenny H Truong
(74) *Attorney, Agent, or Firm* — East IP P.C.

(57) ABSTRACT

The present disclosure relates to the technical field of earphone and provides to an active noise reduction earphone. The active noise reduction earphone includes an earphone shell, a speaker, a sound outlet mouth, a first feedback digital microphone, a second feedback digital microphone and a sound collecting channel. Herein, the speaker divides the earphone shell into the front speaker cavity and the back speaker cavity; the sound outlet mouth is arranged to be faced to the speaker to output the sound emitted by the speaker; the first feedback digital microphone is arranged at the first noise reduction sound collecting hole preset in the back speaker cavity to collect external ambient noise; the sound in the ear canal is collected through the sound collecting channel, and the second feedback digital microphone isolates the sound collecting channel from the front speaker cavity.

16 Claims, 3 Drawing Sheets

ACTIVE NOISE REDUCTION EARPHONE

CROSS REFERENCE TO RELATED APPLICATION

This application claims priority to Chinese Patent Application No. 202122638225.8, filed on Oct. 29, 2021, which is hereby incorporated by reference in its entirety.

TECHNICAL FIELD

The present disclosure relates to the technical field of earphone, and in particular to an active noise reduction earphone.

BACKGROUND

As people use earphone in more and more diversified application scenarios, in order to obtain a better experience in noise scenarios, active noise reduction earphone products have become the mainstream of the earphone market. In order to ensure the noise reduction performance and the wearing comfort, an in-ear soft rubber earplug is designed and used to form a sealed cavity between an earphone and an ear canal, and a microphone, a speaker and a noise reduction chip are used to actively reduce the surrounding noise.

However, a current microphone structure in the earphone is usually designed on the condition that the left and right ears of the user are worn in place. It is difficult to achieve the best noise reduction effect if the user wears it in a different state each time.

SUMMARY

The object of the present application is to provide an active noise reduction earphone, which aims to solve the problems existing in the current active noise reduction earphone.

In a first aspect, an active noise reduction earphone provided by an embodiment of the present disclosure includes an earphone shell;

a speaker, dividing the earphone shell into a front speaker cavity and a back speaker cavity;

a sound outlet mouth, formed in the front speaker cavity and arranged to be faced to the speaker to output sound emitted by the speaker;

a first feedback digital microphone, arranged at a first noise reduction sound collecting hole preset in the back speaker cavity to collect external ambient noise;

a second feedback digital microphone, arranged in the front speaker cavity and fixed inside the earphone shell;

a sound collecting channel, connected to a sound inlet of the second feedback digital microphone, and configured to collect the sound in an ear canal and transmit the collected sound to the sound inlet of the second feedback digital microphone.

In an embodiment, the first feedback digital microphone and the second feedback digital microphone are arranged opposite to each other; and/or a sound inlet of the first feedback digital microphone and the sound inlet of the second feedback digital microphone are arranged to be faced away from each other.

In an embodiment, the sound collecting channel is arranged in the sound outlet mouth.

In an embodiment, there is a first distance between the sound collecting channel and an inner wall of the sound outlet mouth.

In an embodiment, the sound collecting channel is a sound collecting tube; the sound collecting tube is flush with the sound outlet mouth, or a length of the sound collecting tube is greater than a length of the sound outlet mouth and is less than a protruding length of the earphone shell of the earphone.

In an embodiment, the sound outlet mouth is further provided with a soft rubber earplug, and the length of the sound collecting tube is shorter than a protruding length of the soft rubber earplug.

In an embodiment, a mouth of the sound outlet mouth is provided with a filter screen, and the filter screen is configured to adjust the sound emitted by the speaker.

In an embodiment, the filter screen is provided with a mesh with an aperture same as an aperture of the sound collecting tube to allow the sound collecting tube to pass through the filter screen.

In an embodiment, a center of the first noise reduction sound collecting hole is aligned with a center of the sound inlet of the first feedback digital microphone.

In an embodiment, the active noise reduction earphone further includes a call analog microphone, arranged in the back speaker cavity, a call reference analog microphone, arranged at a second noise reduction sound collecting hole preset in the back speaker cavity, in which a sound collecting direction of the call reference analog microphone is perpendicular to a sound collecting direction of the call analog microphone.

The active noise reduction earphone is provided by an embodiment of the present disclosure. The active noise reduction earphone includes the earphone shell, the speaker, the sound outlet mouth, the first feedback digital microphone, the second feedback digital microphone, and the sound collecting channel. Herein, the earphone shell is divided into the front speaker cavity and the back speaker cavity by the speaker; the sound outlet mouth is arranged to be faced to the speaker to output the sound emitted by the speaker; the first feedback digital microphone is arranged at the first noise reduction sound collecting hole preset in the back speaker cavity to collect external ambient noise; the second feedback digital microphone is arranged in the front speaker cavity and fixed inside the earphone shell. The sound collecting channel can receive the sound in the ear canal, and the second feedback digital microphone can isolate the sound collecting channel from the front speaker cavity. The sound collecting channel can receive the sound in the ear canal and shield the sound from the front speaker cavity, so that it can avoid the mutual interference between the noise from the ear canal and the sound from the front speaker cavity, and can improve the noise reduction experience of the earphone.

DETAILED DESCRIPTION

Figure 1:
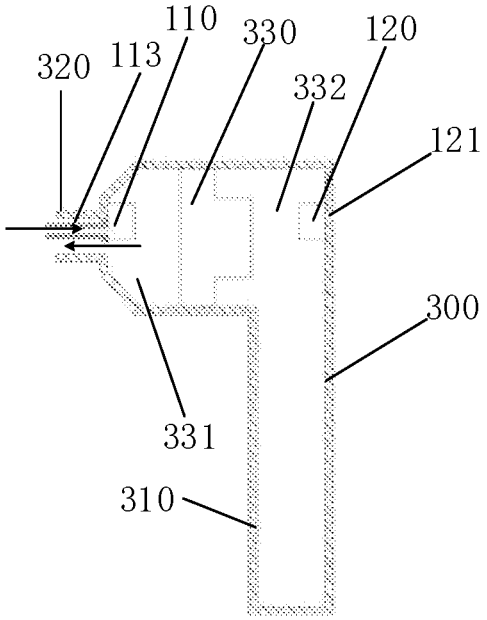
FIG. 1 shows a schematic structural view of an active noise reduction earphone provided by an embodiment of the present application.

In order to make the technical problems, technical solutions and beneficial effects to be solved by the present application clearer, the following further describes the present application in detail with reference to the accompanying drawings and embodiments. It should be understood that the specific embodiments described here are only used to explain the present application, and are not used to limit the present application.

It should be noted that when an element is referred to as being "fixed to" or "arranged in" another element, it can be directly on the other element or indirectly on the other element. When an element is referred to as being "connected to" another element, it can be directly connected to the other element or indirectly connected to the other element.

It should be understood that the orientation or positional relationship indicated by the terms the terms "length", "width", "upper", "lower", "front", "back", "left", "right", "vertical", "horizontal", "top", "bottom", "inner", "outer" and the like are based on the orientation or positional relationship shown in the drawings, and are only for the convenience of describing the present application and simplifying the description, rather than indicate or imply that the device or element referred to must be arranged in a specific orientation and configured and operated in a specific orientation. Therefore, it cannot be understood as a restriction on the present application.

In addition, the terms "first" and "second" are only used for descriptive purposes, and cannot be understood as indicating or implying relative importance or implicitly indicating the number of indicated technical features. Thus, the features defined with "first" and "second" may explicitly or implicitly include one or more of these features. In the description of the present application, "a plurality of" means two or more than two, unless otherwise specifically defined.

The wearing comfort and the sealing performance are the keys to the design of an in-ear earphone. In order to ensure excellent active noise reduction performance, the choice of a microphone and a speaker (loudspeaker) must be considered. In a hybrid noise reduction system, when the user wears an earphone, an ear canal of a human ear and a front speaker cavity are sealed due to a design of a soft rubber earplug and form a communicating cavity. The in-ear earphone further includes two microphones: a front feedback microphone and a back feedback microphone. The front feedback microphone is designed in the back speaker cavity far away from a sounding direction of the speaker to collect external ambient noise, and the back feedback microphone is designed in a cavity at a side of the speaker close to the sounding direction to measure sound emitted by the speaker. The back feedback microphone is very challenging in the structural design of the earphone, because the structural space is very limited, and the acoustic interference caused by the structural design of the speaker needs to be avoided.

In order to solve the problems existing in the current active noise reduction earphone, an active noise reduction earphone is provided by an embodiment of the present application. As shown in FIG. 1, the active noise reduction earphone includes an earphone shell 300, a speaker 330, a sound outlet mouth 320, a first feedback digital microphone 120, a second feedback digital microphone 110 and a sound collecting channel 113.

The earphone shell 300 is divided into a front speaker cavity 331 and a back speaker cavity 332 by the speaker 330; the front speaker cavity 331 and the back speaker cavity 332 are separated by the speaker 330; the sound outlet mouth is arranged at the front speaker cavity 331 facing to the speaker 330 to output the sound emitted by the speaker 330.

The sound collecting channel 113 is connected to a sound inlet of the second feedback digital microphone 110, and the sound collecting channel 113 is used to collect the sound in the ear canal and transmit the collected sound to the sound inlet of the second feedback digital microphone 110. Specifically, the sound collecting channel 113 may be arranged side by side with the sound outlet mouth 320 (for example, arranged on the earphone shell 300, and arranged side by side or parallel with the sound outlet mouth 320), or may be arranged in the sound outlet mouth 320.

The first feedback digital microphone 120 is arranged at a first noise reduction sound collecting hole 121 preset in the back speaker cavity 332, and the first feedback digital microphone 120 is used to collect external ambient noise. The second feedback digital microphone 110 is arranged in the front speaker cavity 331 and fixed inside the earphone shell 300. The second feedback digital microphone 110 is connected to the sound collecting channel 113 to receive the sound in an ear canal input via the sound collecting channel 113.

In the embodiment, the second feedback digital microphone 110 isolates the sound collecting channel 113 from the front speaker cavity 331 and the sound in the ear canal is collected by the sound collecting channel 113 in the sound outlet mouth 320, so that it can avoid the mutual interference between the noise from the ear canal and the sound from the front speaker cavity, and can improve the noise reduction experience of the earphone.

In an embodiment, there is a first distance between the sound collecting channel 113 and an inner wall of the sound outlet mouth 320.

In the embodiment, the sound collecting channel 113 is not in contact with the inner wall of the sound outlet mouth 320, and the first distance is greater than 0, so that it can prevent the sound colleting effect of the sound outlet mouth 320 from being affected due to the vibration of the sound outlet mouth 320, thereby insolating the sound emitted by the speaker and the sound feedback from the ear canal and avoiding the mutual interference between the sound emitted by the speaker and the sound feedback from the ear canal, and improving the noise reduction experience of the earphone.

In an embodiment, as shown in FIG. 1, the sound collecting channel 113 is arranged to be aligned with the sound inlet of the second feedback digital microphone 110, and the sound collecting channel 113 and the sound inlet of the second feedback digital microphone 110 are sealingly connected. When the earphone is working, the sound emitted by the speaker 330 is diffused to the ear canal through the sound outlet mouth 320, and the sound collecting channel 113 receives the sound in the ear canal. Since a direction of the sound emitted by the speaker 330 and a direction of the sound collected by the sound collecting channel 113 are completely opposite and the second feedback digital microphone 110 and the front speaker cavity 331 adopt a cavity design, the sound collecting channel 113 of the second feedback digital microphone 110 is isolated from the front speaker cavity 331, and the sound collecting channel 113 and the sound outlet mouth 320 are relatively independent, so as to avoid the mutual interference between the noise from the ear canal and the sound from the front speaker cavity.

In the embodiment, both of the first feedback digital microphone 120 and the second feedback digital microphone 110 are digital microphones. The digital microphone outputs a digital signal, not a usual analog signal; moreover, the digital microphone has the strong anti-interference ability and will not be interfered or affected by computers, networks and radio frequency magnetic field signal sources. Therefore, there is no need to arrange a high-frequency filter capacitor and a filter circuit in the earphone like a traditional microphone, which can further reduce the space occupied in the earphone.

In an embodiment, the sound collecting channel 113 may be a sound collecting tube, and a shape of a cross section of the sound collecting tube can be any shape, for example, the cross section of the sound collecting tube can be in the shape of round, square or other irregular shapes, and the specific shape can be designed as required.

In an embodiment, the sound collecting tube is flush with the sound outlet mouth 320.

In the embodiment, the sound collecting tube is used to collect the sound in the ear canal. Since the second feedback digital microphone 110 is structurally isolated in the direction of the sound emitted by the speaker 330, the second feedback digital microphone 110 receives the sound in the ear canal. A sound collecting tube is used to collect echo of the ear cavity to eliminate the external noise. In order to prevent the sound passing through the sound outlet mouth 320 from interfering with the sound collection of the sound collecting channel 113, in a specific application embodiment, the sound collecting channel 113 has a length flushing with the sound outlet mouth 320.

Figure 3:
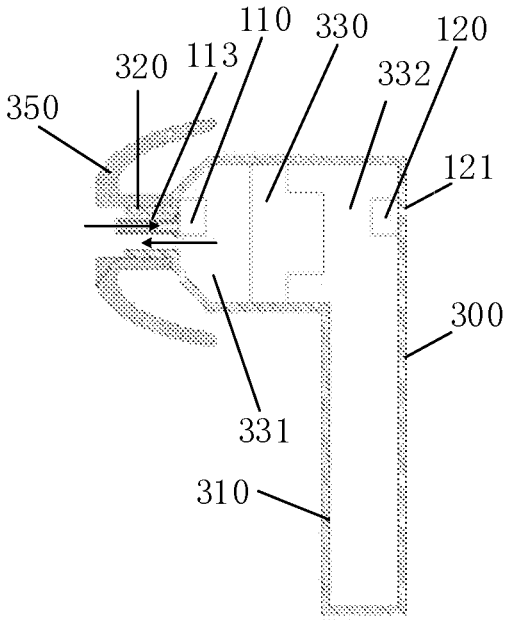
FIG. 3 shows a schematic structural view of another active noise reduction earphone provided by an embodiment of the present application.

In an embodiment, as shown in FIG. 3, a length of the sound collecting tube is greater than a length of the sound outlet mouth 320 and is shorter than a protruding length of the earphone shell of the earphone.

In the embodiment, the sound collecting tube is used to collect the sound in the ear canal. Since the second feedback digital microphone 110 is structurally isolated in the direction of the sound emitted by the speaker 330, the second feedback digital microphone 110 receives the sound in the ear canal. A sound collecting tube is used to collect echo of the ear cavity to eliminate the external noise. In order to prevent the sound passing through the sound outlet mouth 320 from interfering with the sound collection of the sound collecting channel 113, in a specific application embodiment, a length of the sound collecting tube is greater than a length of the sound outlet mouth 320, so that the sound collecting tube protrudes from the sound outlet mouth 320; and in order to prevent the length of the sound collecting tube from being too long to affect the use by the user, the length of the sound collecting tube needs to be shorter than the protruding length of the earphone shell of the earphone.

In an embodiment, as shown in FIG. 3, the sound outlet mouth 320 is provided with a soft rubber earplug 350, and the length of the sound collecting tube is shorter than a protruding length of the soft rubber earplug 350.

In the embodiment, the sound collecting tube is used to collect the sound in the ear canal. In order to prevent the sound collecting tube from being too long, the soft rubber earplug 350 is usually arranged on the sound outlet mouth 320 of the earphone. Therefore, the soft rubber earplug 350 can be used as a reference. In a specific application, in order to prevent the length of the sound collecting tube from being too long to affect the use by the user, the length of the sound collecting tube needs to be shorter than the protruding length of the soft rubber earplug 350 of the earphone.

Figure 2:
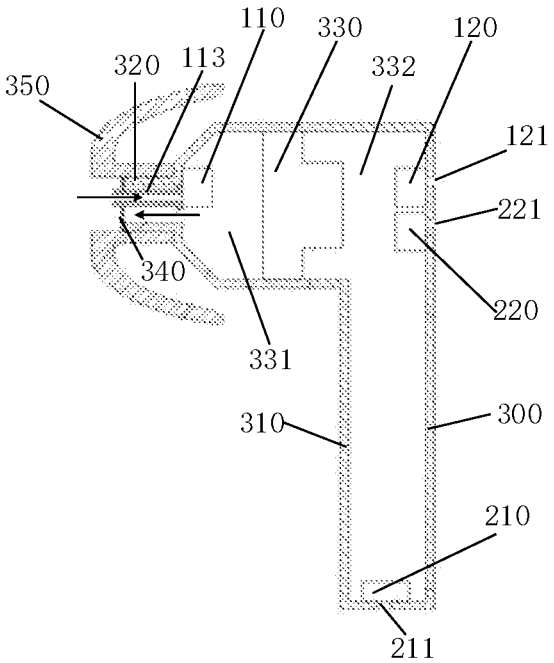
FIG. 2 shows a schematic structural view of another active noise reduction earphone provided by an embodiment of the present application.

In an embodiment, as shown in FIG. 2, the sound outlet mouth 320 is provided with a filter screen 340, and the filter screen 340 is used to adjust the sound emitted by the speaker.

In an embodiment, as shown in FIG. 2, the filter screen 340 is provided with a mesh with an aperture same as an aperture of the sound collecting channel 113 to allow the sound collecting channel 113 to pass through the filter screen 340.

In the embodiment, the mesh on the filter screen 340 has the aperture same as the aperture of the sound channel 113, and the filter screen 340 is sealingly connected to the sound collecting channel 113 to prevent sound leakage.

In an embodiment, the filter screen 340 is used to allow the sound of the speaker 330 to enter the ear canal, and to shield the sound of the ear canal from entering the front speaker cavity 331.

In the embodiment, the filter screen 340 can be the filter screen that allows the sound to pass through in one direction. The filter screen 340 can shield the sound of the ear canal from entering the front speaker cavity without affecting the speaker 330 to emit the sound, thereby avoiding the sound returning in the ear canal from interfering with the sound emitted by the speaker 330, and further improving the noise reduction effect of the earphone.

In an embodiment, the first noise reduction sound collecting hole 121 and a second noise reduction sound collecting hole 221 are both arranged in the back speaker cavity 332 and arranged side by side for collecting the ambient noise.

In an embodiment, the first feedback digital microphone 120 and the second feedback digital microphone 110 are arranged to be faced to each other.

In the embodiment, the first feedback digital microphone 120 is designed in the back speaker cavity 332 far away from the sounding direction of the speaker 330 to collect the external ambient noise; the second feedback digital microphone 110 is designed in the front speaker cavity 331 at the side of the speaker close to the sounding direction to measure the sound emitted by the speaker. By arranging the first feedback digital microphone 120 and the second feedback digital microphone 110 to be faced to each other in the earphone, the ambient noise in front and back of the earphone can be effectively collected, a corresponding noise reduction algorithm can be adopted, thus, a better practical experience can be brought to the user.

In an embodiment, a center of the first noise reduction sound collecting hole 121 is aligned with a center of the sound inlet of the first feedback digital microphone 120.

In the embodiment, by aligning the center of the first noise reduction sound collecting hole 121 with the center of the sound inlet of the first feedback digital microphone 120, an arrangement of a microphone structure in the active noise reduction earphone can be made more compact without affecting the sound collecting function, and a volume of the microphone structure can be reduced; the sound inlet of the first feedback digital microphone 120 is sealingly connected to the first noise reduction sound collecting hole 121, so as to prevent the sound passing through the first noise reduction sound collecting hole 121 from entering the back speaker cavity 332 and causing the interference to the sound of the speaker.

In an embodiment, as shown in FIG. 2, the active noise reduction earphone in the embodiment further includes an ear rod 310.

In an embodiment, as shown in FIG. 2, the active noise reduction earphone further includes a call analog microphone 210 and a call reference analog microphone 220.

In the embodiment, the call analog microphone 210 is arranged in the ear rod 310, and a sound collecting direction of the call analog microphone 210 is the same as a direction of the ear rod of the earphone. Specifically, as shown in FIG. 2, the call analog microphone 210 is arranged at a call sound collecting hole 211, and the call sound collecting hole 211 points to a direction of a mouth.

A center of a sound collecting hole of the call analog microphone 210 is aligned with a center of the call sound collecting hole 211, and the call sound collecting hole of the call analog microphone 210 is sealingly connected to the sound collecting hole 211, so that it can prevent the sound in the call sound collecting hole 211 from entering the earphone and causing the interference to the sound emitted by the speaker.

The call reference analog microphone 220 is arranged at a second noise reduction sound collecting hole 221 preset in the back speaker cavity 332, the call reference analog microphone 220 is aligned with the second noise reduction sound collecting hole 221, and the sound collecting hole of the call reference analog microphone 220 is sealingly connected to the second noise reduction sound collecting hole 221, which can prevent the sound in the second noise reduction sound collecting hole 221 from entering the earphone and causing interference to the sound emitted by the speaker.

A sound collecting direction of the call reference analog microphone 220 is perpendicular to the sound collecting direction of the call analog microphone 210. At this time, the call reference analog microphone 220 is used to collect an external ambient noise signal, and is used to provide a reference signal for a sound collecting signal of the call analog microphone 210, so as to perform noise reduction for the sound of the user.

Figure 4:
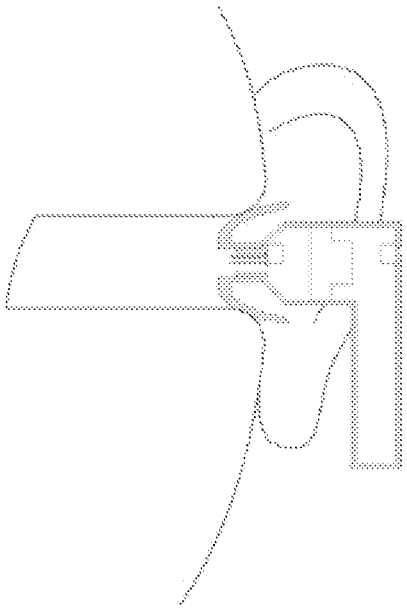
FIG. 4 shows a schematic view of a state when a user wears an earphone provided by an embodiment of the present application.
Figure 5:
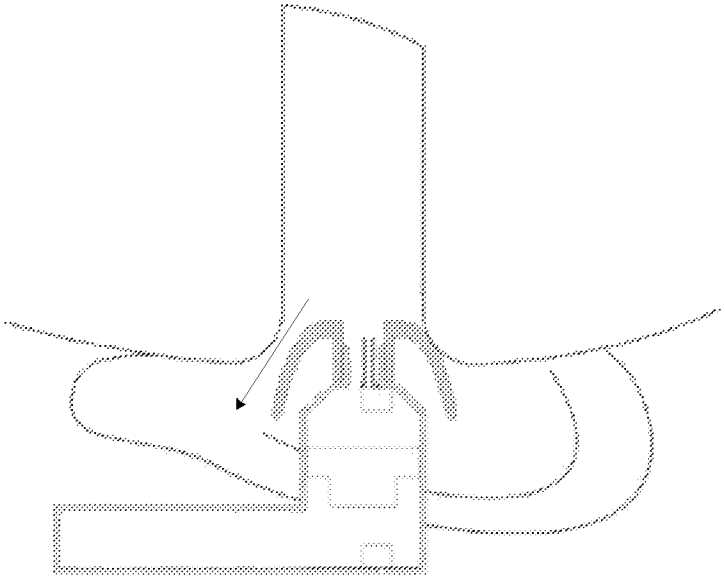
FIG. 5 shows a schematic view of another state when a user wears an earphone provided by an embodiment of the present application.

FIGS. 4 and 5 show a schematic view of a state when the user wears the earphone. FIG. 4 shows a state that when the user wears the earphone, the soft rubber earplug fits and seals well with the ear canal, and the sound leakage is relatively small. FIG. 4 shows a state that when the user wears the earphone, the soft rubber earplug does not fit well with the ear canal, and the sound leakage is relatively large.

Generally, in some designs of the active noise reduction earphone, most feedback microphones are currently designed at a side wall of the front speaker cavity. This design can only obtain the best noise reduction experience in the case that the user wears the left earphone and the right earphone in place and the sealing performances of the left ear and the right ear are consistent. Due to the individual differences among the users and the difference between the left ear and right ear of a certain user, the noise reduction experiences will be different for different users, and even the experiences of the left and right ears of the certain user will be different. The soft rubber earplugs may be also different, so that it is difficult to achieve the best sealing effect.

In actual use, the better noise reduction experience can be obtained when the earphone is worn in the state shown in FIG. 4. However, during the actual use, it is difficult to ensure that the user can wear the left and right earphones in the best place at the same time at all times. With the active noise reduction earphone in the embodiments of the present application, the sound collecting tube protrudes out of the sound outlet mouth, and the sound collecting tube is isolated from the front speaker cavity by the second feedback digital microphone, so as to avoid the interference between the noise of the ear canal and the sound of the front speaker cavity; even in the case where the best place of the earphone worn cannot be achieved during the actual use, it can still provide the high-performance noise reduction experience.

In a specific application, the active noise reduction earphone in the embodiment of the present application may include the ear bar 310. A shape of the ear rod 310 can be designed as required. Further, if the active noise reduction earphone is a bean-shaped earphone, a structure of the ear bar in FIG. 2 can be omitted.

Those skilled in the art can clearly understand that, for describing more conveniently and more briefly, only the division of the above-mentioned functional units and modules is used for illustration. In actual applications, the above functions can be allocated by different functional units and modules to complete as required; in other words, the internal structure of the device is divided into different functional units or modules to complete all or part of the functions described above.

In the above-mentioned embodiments, the description of each embodiment has its own focus. If there is no detailed or recorded part in a certain embodiment, the related descriptions of other embodiments can be referred.

The units described as separate components may or may not be physically separate, and the components shown as the units may or may not be the physical units, that is, it can be located in one place, or it can be distributed to multiple network units. Parts or all of the units may be selected according to actual needs to achieve the objectives of the solutions of the embodiments.

In addition, the functional units in the various embodiments of the present application may be integrated into one processing unit, or each unit may exist separately in physic, or two or more units may be integrated into one unit. The above-mentioned integrated unit can be implemented in the form of hardware or software functional unit.

The above-mentioned embodiments are only used to illustrate the technical solutions of the present application, but not to limit them; Although the present application has been described in detail with reference to the foregoing embodiments, those skilled in the art should understand that: the technical solutions recorded in the foregoing embodiments can still be modified, or some of the technical features can be equivalently replaced; these modifications or replacements do not cause the essence of the corresponding technical solutions to deviate from the gist and the scope of the technical solutions of the embodiments of the present application, and should be included in the protection scope of the present application.

What is claimed is:

1. An active noise reduction earphone, comprising an earphone shell;

a speaker, dividing the earphone shell into a front speaker cavity and a back speaker cavity;

a sound outlet mouth, formed in the front speaker cavity and arranged to be faced to the speaker to output sound emitted by the speaker;

a first feedback digital microphone, arranged at a first noise reduction sound collecting hole preset in the back speaker cavity to collect external ambient noise;

a second feedback digital microphone, arranged in the front speaker cavity and fixed inside the earphone shell;

a sound collecting channel, connected to a sound inlet of the second feedback digital microphone, and configured to collect the sound in an ear canal and transmit the collected sound to the sound inlet of the second feedback digital microphone;

wherein a mouth of the sound outlet mouth is provided with a filter screen, and the filter screen is configured to adjust the sound emitted by the speaker; the filter screen is provided with a mesh with an aperture same as an aperture of the sound collecting tube to allow the sound collecting tube to pass through the filter screen.

2. The active noise reduction earphone according to claim 1, wherein the first feedback digital microphone and the second feedback digital microphone are arranged opposite to each other; and/or a sound inlet of the first feedback digital microphone and the sound inlet of the second feedback digital microphone are arranged to be faced away from each other.

3. The active noise reduction earphone according to claim 1, wherein the sound collecting channel is arranged in the sound outlet mouth.

4. The active noise reduction earphone according to claim 3, wherein there is a first distance between the sound collecting channel and an inner wall of the sound outlet mouth.

5. The active noise reduction earphone according to claim 3, wherein the sound collecting channel is a sound collecting tube; the sound collecting tube is flush with the sound outlet mouth, or a length of the sound collecting tube is greater than a length of the sound outlet mouth and is shorter than a protruding length of the earphone shell of the earphone.

6. The active noise reduction earphone according to claim 5, wherein the sound outlet mouth is further provided with a soft rubber earplug, and the length of the sound collecting tube is shorter than a protruding length of the soft rubber earplug.

7. The active noise reduction earphone according to claim 1, wherein a center of the first noise reduction sound collecting hole is aligned with a center of the sound inlet of the first feedback digital microphone.

8. The active noise reduction earphone according to claim 1, further comprising a call analog microphone, arranged in the back speaker cavity;

a call reference analog microphone, arranged at a second noise reduction sound collecting hole preset in the back speaker cavity;

wherein a sound collecting direction of the call reference analog microphone is perpendicular to a sound collecting direction of the call analog microphone.

9. An active noise reduction earphone, comprising an earphone shell;

a speaker, dividing the earphone shell into a front speaker cavity and a back speaker cavity;

a sound outlet mouth, formed in the front speaker cavity and arranged to be faced to the speaker to output sound emitted by the speaker;

a first feedback digital microphone, arranged at a first noise reduction sound collecting hole preset in the back speaker cavity to collect external ambient noise;

a second feedback digital microphone, arranged in the front speaker cavity and fixed inside the earphone shell;

a sound collecting channel, connected to a sound inlet of the second feedback digital microphone, and configured to collect the sound in an ear canal and transmit the collected sound to the sound inlet of the second feedback digital microphone;

a call analog microphone, arranged in the back speaker cavity;

a call reference analog microphone, arranged at a second noise reduction sound collecting hole preset in the back speaker cavity;

wherein a sound collecting direction of the call reference analog microphone is perpendicular to a sound collecting direction of the call analog microphone.

10. The active noise reduction earphone according to claim 9, wherein the first feedback digital microphone and the second feedback digital microphone are arranged opposite to each other; and/or a sound inlet of the first feedback digital microphone and the sound inlet of the second feedback digital microphone are arranged to be faced away from each other.

11. The active noise reduction earphone according to claim 9, wherein the sound collecting channel is arranged in the sound outlet mouth.

12. The active noise reduction earphone according to claim 11, wherein there is a first distance between the sound collecting channel and an inner wall of the sound outlet mouth.

13. The active noise reduction earphone according to claim 11, wherein the sound collecting channel is a sound collecting tube; the sound collecting tube is flush with the sound outlet mouth, or a length of the sound collecting tube is greater than a length of the sound outlet mouth and is shorter than a protruding length of the earphone shell of the earphone.

14. The active noise reduction earphone according to claim 13, wherein the sound outlet mouth is further provided with a soft rubber earplug, and the length of the sound collecting tube is shorter than a protruding length of the soft rubber earplug.

15. The active noise reduction earphone according to claim 9, wherein a mouth of the sound outlet mouth is provided with a filter screen, and the filter screen is configured to adjust the sound emitted by the speaker.

16. The active noise reduction earphone according to claim 9, wherein a center of the first noise reduction sound collecting hole is aligned with a center of the sound inlet of the first feedback digital microphone.

* * * * *